United States Patent [19]

Carini

[11] 4,413,762

[45] Nov. 8, 1983

[54] GAME BALL HOLDER

[76] Inventor: Edward Carini, 20 Stewart Pl., Mount Kisco, N.Y. 10549

[21] Appl. No.: 313,803

[22] Filed: Oct. 22, 1981

[51] Int. Cl.[3] ..... A45F 5/00

[52] U.S. Cl. ..... 224/250; 224/908; 2/250; 206/315.9

[58] Field of Search ..... 224/250, 249, 254, 257, 224/258, 919, 908; 206/315 B; 2/250

[56] References Cited

U.S. PATENT DOCUMENTS

| | | | |
|---|---|---|---|
| 2,074,180 | 4/1936 | Hatley . | |
| 3,744,059 | 7/1973 | Hayes . | |
| 3,871,030 | 3/1975 | Green . | |
| 3,873,009 | 3/1975 | Goudreau . | |
| 4,061,256 | 12/1977 | Beer et al. . | |
| 4,065,040 | 12/1977 | Steere . | |
| 4,072,256 | 2/1978 | Young . | |
| 4,079,871 | 3/1978 | Sica . | |
| 4,119,247 | 10/1978 | Newquist et al. | 224/5 D |
| 4,168,022 | 9/1979 | Brewer | 224/257 |
| 4,266,706 | 5/1981 | Gould | 224/908 X |

*Primary Examiner*—Steven M. Pollard

*Attorney, Agent, or Firm*—Myron Greenspan; Burton L. Lilling; Bruce E. Lilling

[57] ABSTRACT

A game ball holder for holding a ball, such as a tennis ball, on a garment. The holder includes two elongate strips of elastic material arranged side by side with one lateral edge of one strip adjacent to one lateral edge of the other. The adjacent lateral edges are joined together along a prescribed length from each end and unjoined for a prescribed length midway between the ends. The strips are either attached directly to a garment or attached to a base of cloth material which, in turn, is attached to the garment.

10 Claims, 6 Drawing Figures

GAME BALL HOLDER

BACKGROUND OF THE INVENTION

The present invention relates generally to ball holding devices and, more specifically, to devices which may be worn on a garment for releasably grasping a game ball, such as a tennis ball.

Many games require a player to carry a plurality of game balls on his person in order to facilitate game play. For example, in the game of tennis or squash, each player typically carries three balls to promote play of the game. For many players it is quite difficult to carry three balls in one hand. If the player has a pocket, one of the two spare balls may be placed in his or her pocket; however, the rather large volume of a tennis ball relative to the size of the typical pocket on tennis attire causes the garment to tighten about the player's body which restricts the player's freedom of movement. Not only is it difficult and distracting from the game to insert and remove a tennis ball from the pocket of the garment but a ball in a pocket also produces an unsightly bulge which is undesirable.

The U.S. Pat. No. 3,871,030 discloses a woman's tennis panty which is provided with specially designed pockets for holding a tennis ball. The problem of an unsightly bulge is avoided in this case because the tennis panty is intended for use as an undergarment to be covered by a short tennis skirt. However, the problem of restriction of the player's freedom still remains with this design.

Quite a number of tennis ball holders have been designed as a modified belt having pockets large enough to removably receive one or more balls. Typical designs are disclosed in the U.S. Pat. Nos. 2,074,180; 3,873,009; 4,065,040; 4,072,256; and 4,079,871. Such types of ball holders are unaesthetic, inconvenient to use and, like the tennis panty, they tend to interfere with the player's freedom of movement.

Still another type of tennis ball holder is disclosed in the U.S. Pat. No. 4,061,256. This holder comprises an armlet designed to be worn on the lower arm during a game and having a pouch for insertion of a tennis ball. This ball holder is visually unorthodox and also somewhat uncomfortable to wear.

In order to avoid the problems noted above, several ball holders have been designed for separate attachment to a game (tennis) garment at any desired position. The U.S. Pat. No., 3,744,059 discloses an attachable tennis ball pocket which can retain a ball without interfering with the wearer during play. The pocket includes a base element for attachment to the garment and to which is affixed a fabric material of sufficient elasticity to receive and hold the ball, permit ready removal thereof, and which lies flat and remains unobtrusive when empty. The fabric material is disclosed as being in the form of netting such as "Raschel Power Net Knit"; also disclosed are elastic fabrics such as Lycra.

Although this type of tennis ball holder solves the principle problem of aesthetics, inconvenience and interference with movement, it is relatively expensive to produce. The pocket requires an elastomeric band along the upper open edge of the elastic fabric so as to continually urge this upper free edge or lip of the pocket toward the backing and into a closed position to retain the tennis ball.

Another garment-supportable tennis ball pocket is disclosed in the U.S. Pat. No. 4,119,247. This pocket is made of relatively stiff, flexible material such as plastic. The pocket may be formed or molded in one piece from such plastic, which may be low density polyethylene.

Although this tennis ball pocket may be produced relatively economically in large quantities through mass production techniques, the production of smaller quantities is expensive. In addition, the stiffness of the pocket does not permit it to lie flat against the garment when a ball is not inserted therein.

SUMMARY OF THE INVENTION

It is a principle object of the present invention to provide a game ball holder which is economical to produce in both small and large quantities.

It is another object of the present invention to provide a game ball holder which permits a game ball to be easily inserted and removed so as not to disturb the natural flow of the game.

It is another object of the present invention to provide a game ball holder which may be attached to a garment at a convenient location so as not to interfere with the game player's movement.

It is a further object of the present invention to provide a game ball holder which, when attached to a garment and not holding a ball, lies flat against the garment, thereby providing an aesthetic appearance when the garment wearer is not playing the game.

These objects, as well as other objects which will become apparent from the discussion that follows are achieved, according to the present invention, by forming the ball holder of two elongate strips of elastic material. These strips are arranged side by side with the lateral edge of one strip adjacent to the lateral edge of the other. These adjacent lateral edges are joined together along a prescribed length from each end of the strips and remain unjoined for a prescribed length midway between the ends. It has been found that if two strips of such configuration are attached to a garment at their ends so as to normally lie flat against the surface of the garment, they can conveniently hold a ball, such as a tennis ball, which is inserted between the strips and the garment.

In a preferred embodiment of the invention, the ball holder further includes a base, made of a material which may be the same as that of the garment, to which are attached the two elastic strips. The strips with the base thus form a separate unit which may be "retrofitted" to any garment at any desired location.

For a full understanding of the present invention, reference should now be made to the following detailed description of the preferred embodiments of the invention and to the accompanying drawings.

DESCRIPTION OF THE PREFERRED EMBODIMENTS

Figure 1:
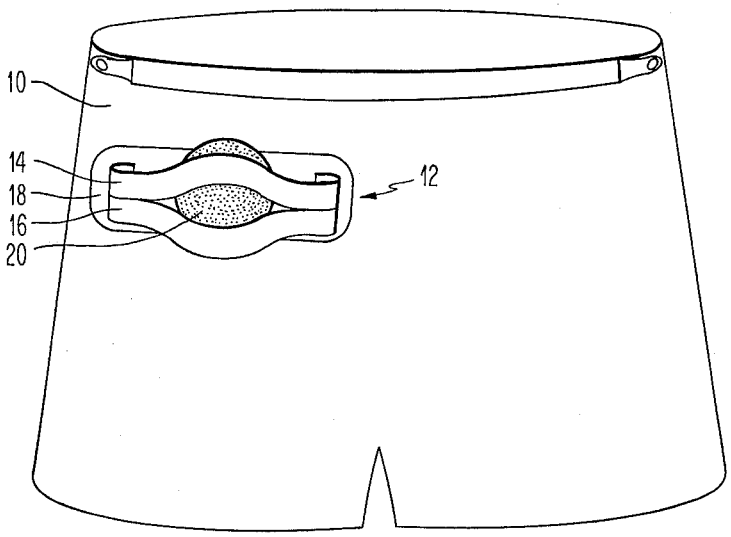
FIG. 1 is a rear view of a tennis garment to which is attached a tennis ball holder according to the present invention.

The preferred embodiments of the present invention will now be described with reference to FIGS. 1–6. Identical elements in the various figures are designated with the same reference numerals.

FIG. 1 shows a man's tennis shorts 10 having attached thereto a tennis ball holder 12 according to the present invention. This tennis ball holder comprises two strips 14 and 16 of elastic material attached to a base 18. The base, in turn, is attached to the garment 10.

FIG. 1 shows the tennis ball holder grasping a tennis ball 20 between the strips 14, 16 and the base 18.

The elastic strips are preferably each about 1" wide and 6" inches long. They are arranged side by side with their lateral edges sewn together for a distance of about 1½" on each end. This allows about a 3" inch gap midway between the ends to cradle the tennis ball. The strips may be made of a stretchable cloth material such as elastic polyester webbing of the type used in suspenders or belting.

When the ball is inserted behind the two elastic strips the ball forces the strips to separate where they are not sewn together thus forming a gap which cradles the ball so that it can not slip out. The ball is thereby securely held in place.

When not in use holding a ball, the elastic strips flatten out as a decorative style detail on the garment, which may be either a man's shorts or a woman's skirt.

Figure 2:
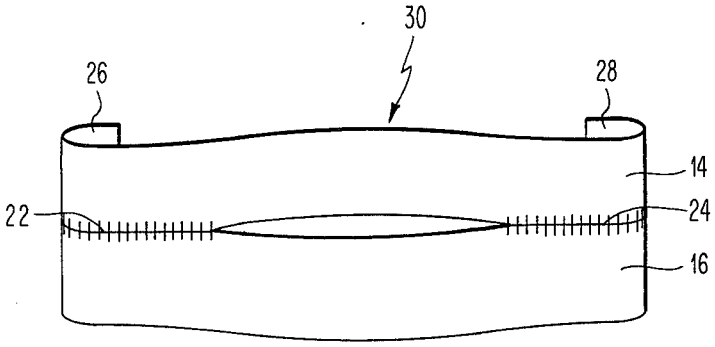
FIG. 2 is a front view of the tennis ball holder according to a first preferred embodiment of the present invention.

FIG. 2 shows one preferred embodiment of the tennis ball holder according to the invention as it might be applied to a garment when the garment is made. In this embodiment, the holder comprises only the two elastic strips 14 and 16 sewn together along their lateral edges as indicated by the stitching 22 and 24. In this embodiment, end portions 26 and 28 of the two strips are folded back underneath the central portions indicated at 30 in order to hide the means of attachment to the garment. These means of attachment may be stitches, snaps or an adhesive.

Figure 3:
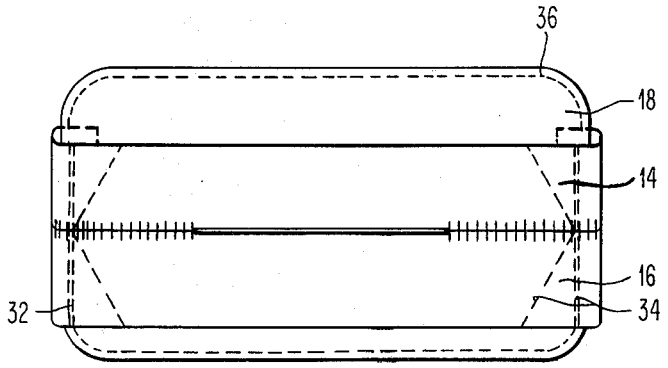
FIG. 3 is a front view of the tennis ball holder according to a second preferred embodiment of the present invention.

FIG. 3 shows another embodiment of the present invention in which strips 14 and 16 are attached to a base 18. The base may be made of a cloth material, preferably similar to that of the garment to which it will be applied. The elastic strips are attached to the base by stitches 32 and 34; the base is, in turn, attached to the garment by stitches 36. The ends of the strips 14 and 16 wrap around the base 18 and are therefore also directly stitched to the garment.

Figure 4:
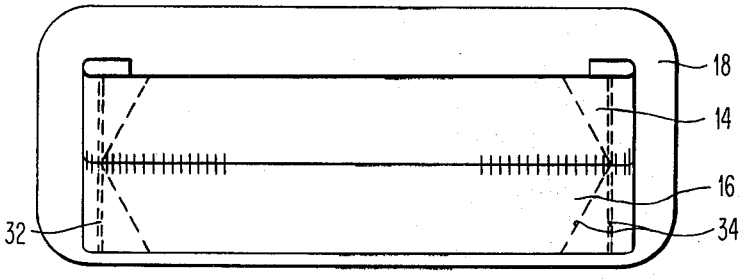
FIG. 4 is a front view of the tennis ball holder according to a third preferred embodiment of the present invention.

FIG. 4 shows another embodiment of the present invention wherein the base 18 is longer than the strips 14 and 16. In this case, the strips are attached to the base by stitching 32 and 34; however, the base is provided with an iron-on coating on the side opposite to the two strips for ease of attachment to the garment. The use of a base 18, and particularly with an iron-on coating, permits the ball holder to be easily applied by a customer to a garment, thereby "retrofitting" the ball holder to an existing garment.

Figure 5:
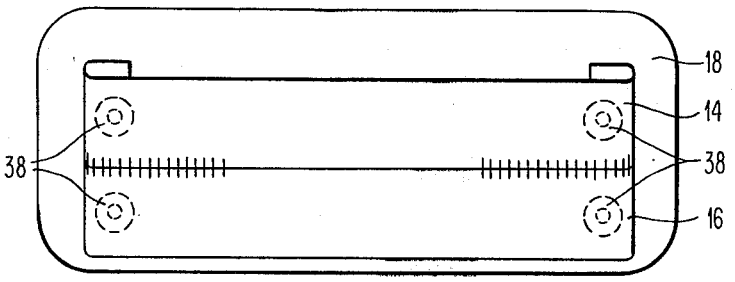
FIG. 5 is a front view of the tennis ball holder according to a fourth preferred embodiment of the present invention.
Figure 6:
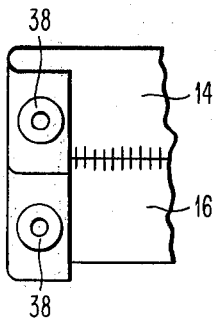
FIG. 6 is a rear view of one end of the strips employed in the embodiment of FIG. 5.

FIGS. 5 and 6 illustrate still another embodiment of the present invention whereby the strips 14 and 16 are attached to the base 18 by snaps 38. This type of attachment facilitates removal and replacement of the strips when they become worn or otherwise unsightly.

There has thus been shown and described a novel game ball holder which fulfills all the objects and advantages sought therefore. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention which is to be limited only by the claims which follow.

I claim:

1. A ball holder adapted for use on a garment comprising two elongate strips of elastic material, each having two ends and two lateral edges, said strips being arranged side by side with one lateral edge of one strip adjacent to one lateral edge of the other, the adjacent lateral edges being joined together along a prescribed length from each end and unjoined for a prescribed length midway between said ends, the ends of said strips being adapted for attachment to a garment.

2. The ball holder defined in claim 1 further comprising a base adapted for attachment to a garment, the ends of said strips being attached to said base.

3. The ball holder defined in claim 2, wherein opposite end portions of each strip are folded back underneath a central portion, such end portions being attached to said base, whereby the means of attachment are hidden from view.

4. The ball holder defined in claim 2, wherein said base is made of cloth.

5. The ball holder defined in claim 2, wherein the base is made of the same material as the garment to which it is adapted to be attached.

6. The ball holder defined in claim 2 wherein said base has an iron-on coating on the side thereof opposite said two strips for ease of attachment to the garment.

7. The ball holder defined in claim 2 wherein said strips are sewn to said base.

8. The ball holder defined in claim 2 wherein said strips are affixed to said base with snaps.

9. The ball holder defined in claim 1, wherein said lateral edges of said strips are joined together along a line approximately ¼ of the total strip length from each end.

10. The ball holder defined in claim 1, wherein said strips are approximately 6" in length, whereby they are designed to hold a tennis ball.

* * * * *